United States Patent [19]

Smith

[11] 4,419,043

[45] Dec. 6, 1983

[54] CENTRIFUGAL PUMP

[76] Inventor: Thomas W. Smith, 2819 Caldwell Blvd. No. 68, Nampa, Id. 83651

[21] Appl. No.: 318,488

[22] Filed: Nov. 5, 1981

[51] Int. Cl.[3] ..... F04D 1/14

[52] U.S. Cl. ..... 415/7; 415/88

[58] Field of Search ..... 415/7, 88, 83; 416/84–86; 239/219, 221; 261/91, 120

[56] References Cited

U.S. PATENT DOCUMENTS

| | | | |
|---|---|---|---|
| 1,535,147 | 4/1925 | Colpitts | 239/219 |
| 3,193,260 | 7/1965 | Lamb | 261/120 X |
| 3,680,845 | 8/1972 | Carlsmith et al. | 261/120 X |
| 3,846,517 | 11/1974 | Ross | 261/91 |
| 4,001,077 | 1/1977 | Kemper | 239/221 X |
| 4,023,041 | 5/1977 | Chappell | 416/85 X |
| 4,130,612 | 12/1978 | Wilop | 239/219 X |
| 4,322,377 | 3/1982 | Kaelin | 261/91 |

FOREIGN PATENT DOCUMENTS

| | | | |
|---|---|---|---|
| 655784 | 4/1929 | France | 415/88 |
| 1310912 | 3/1973 | United Kingdom | 239/219 |
| 383475 | 10/1978 | U.S.S.R. | 239/219 |

*Primary Examiner*—Everette A. Powell, Jr.
*Attorney, Agent, or Firm*—Paul F. Horton

[57] ABSTRACT

A centrifugal pump including a vertical axle, a flotation member rotatingly engaging the axle for lateral support, a plurality of equidistant radially extending conduits supported by the flotation member, each of the conduits including an intake port adjacent the vertical axis of the flotation member and submersed in the liquid to be pumped and upon which the flotation member of bouyed and a discharge port adjacent the outer terminal edge of the flotation member, and a drive system for rotating the flotation member.

3 Claims, 3 Drawing Figures

CENTRIFUGAL PUMP

BACKGROUND OF THE INVENTION

1. Field of the Invention

This invention relates to centrifugal pumps in general and to pumps which are supported by the medium being pumped, in particular.

2. Description of the Prior Art

It is highly desirable to move a large quantity of liquid speedily, with a minimum of expended energy, and with a minimum of stress on machine parts. It is also highly desirable that the liquid mover be in close proximity to the liquid which is to be moved. U.S. Pat. No. 1,535,147 issued to F. H. Colpitts discloses an apparatus including a plurality of outwardly slanting conduits vertically and laterally supported by a central shaft which utilizes inertia of the liquid being pumped to initiate the lifting movement. While being highly efficient in the movement of liquids, the Colpitts apparatus is not self-adjusting to the level of fluid being pumped, is not supported by the liquid being pumped, and where large amounts of liquid are to be pumped requires massive support structure and great stress on the support bearings in that the entire weight of the conduits, the water contained therein, and the support structure is born by a single vertical shaft and its support bearings. U.S. Pat. Nos. 3,735,926 and 3,739,986 issued to R. B. Ravitts and U.S. Pat. Nos. 3,771,724; 3,833,173; and 3,998;389 issued to Rose et al are relevant in showing floating structures having an impeller for pumping liquid. The flotation members disclosed by Rivetts and Rose do not rotate and are not useful in utilizing centrifugal force for pumping.

SUMMARY OF THE INVENTION

The present invention comprises, generally, a centrifugal pump having lateral support means; a rotatable flotation member; a plurality of radially extending conduits supported by the flotation member, each of the conduits having an end adjacent the center of the flotation member submersed in water and an opposing end adjacent the outer terminal end of the flotation member open for the discharge of water; and drive means for rotating said flotation member. A more precise and complete description of the invention may be found in the appended claims.

It is a primary object of the present invention to provide a pump which is operable to move a large quantity of liquid with a minimum expenditure of energy and with a minimum amount of structural stress.

It is also an object of the present invention to provide a pump which floats on the liquid to be pumped and which utilizes the inertia of the liquid to provide liquid flow.

More particularly, it is an object of the present invention to provide a centrifugal pump utilizing liquid inertia to provide liquid flow and having a low friction rotatable flotation member which rides on a column of air in the support of the conduits through which the liquid flows.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
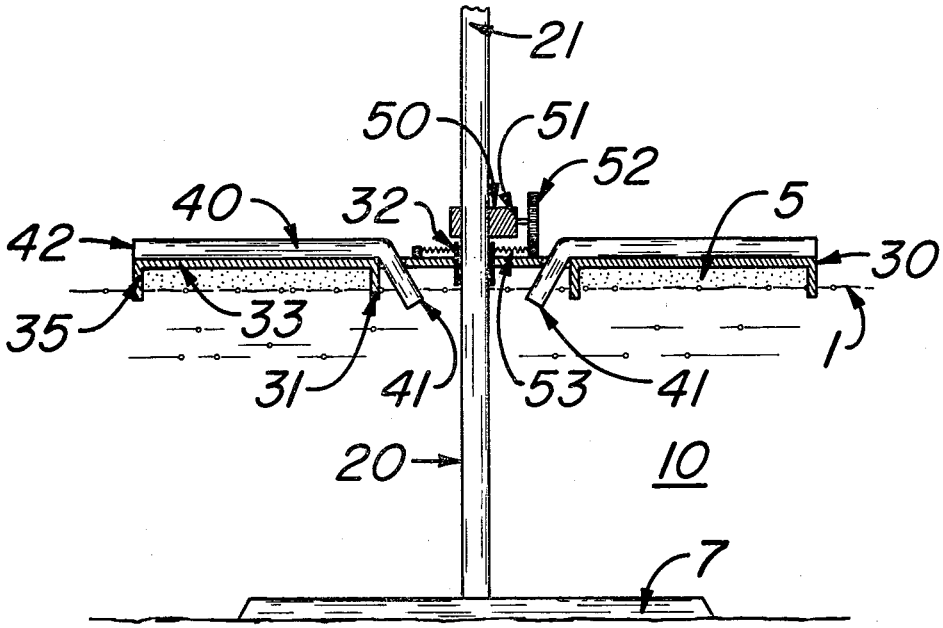
FIG. 1 is a vertical section view of one embodiment of the pump of the present invention.

Referring now to the drawings, an embodiment to be preferred of a centrifugal pump 10 made according to the present invention is disclosed. Pump 10 includes lateral support means 20, a flotation member 30, one or more conduits 40 and drive means 50.

Figure 2:
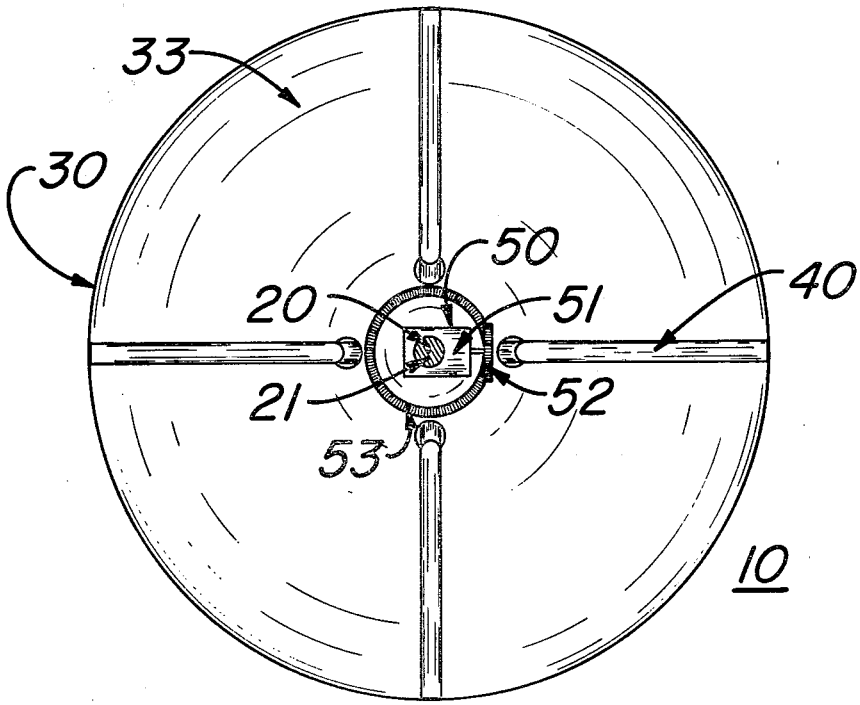
FIG. 2 is a plan view of the pump shown in FIG. 1.
Figure 3:
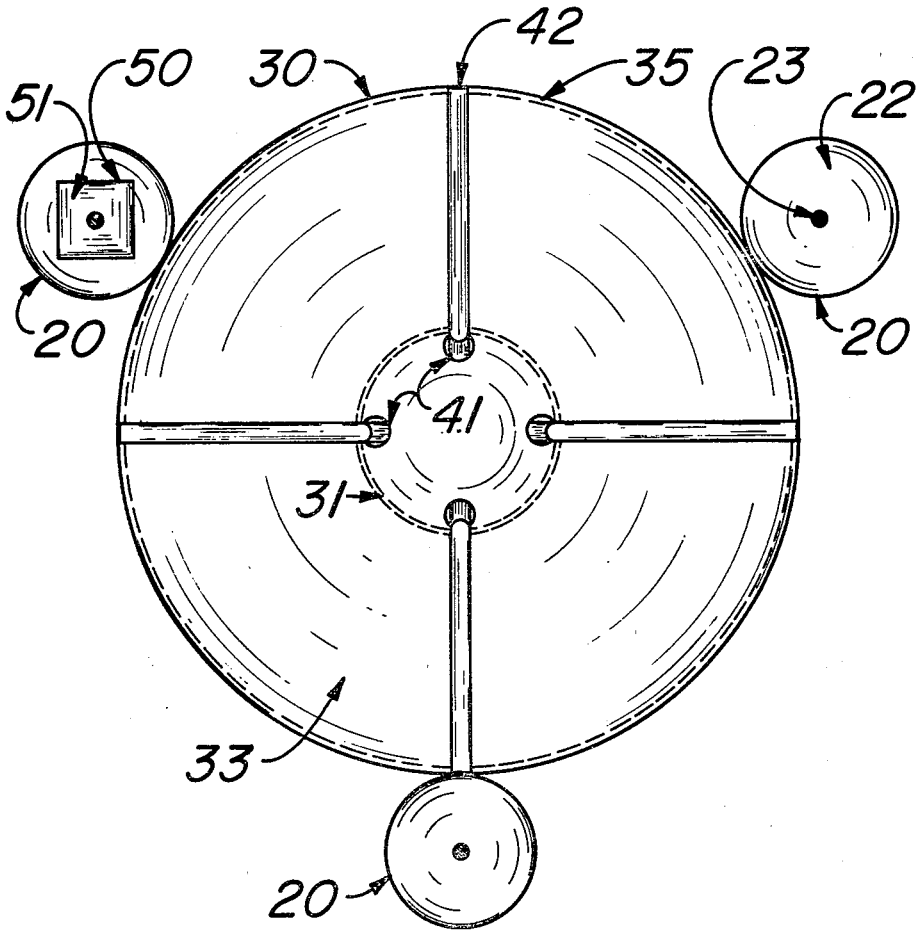
FIG. 3 is a plan view of a second embodiment of the pump of the present invention.

Lateral support means 50, in the preferred embodiment, is a vertical shaft 21 anchored to the floor 7 of a reservoir as shown to advantage in FIGS. 1 and 2. Shaft 21 prevents lateral movement of flotation member 30 and permits both vertical and rotational movement of the flotation member as will hereinafter be explained. It is to be understood that other types of lateral support means may be used in similar manner as shown by a second embodiment in FIG. 3. In the second embodiment a plurality of wheels 22 supported on axles 23 surround platform 30 and are operable to engage the terminal edge of the platform. The axle-wheel assemblies may be, in turn, anchored to either an overlying or underlying structure, not shown.

Flotation member 30 is a critical element of the present invention in providing physical support to the radially extending conduits 40 and for providing a minimum of friction as it is rotated on a column of air. Flotation member 30 includes a horizontal air-tight circular platform 33 provided with two or more concentric downwardly depending annular flanges 31 and 35 which sealingly engage platform 33 to define one or more flotation air tanks between the flanges. Where the lateral support means 20 is in the form of a vertical shaft 21, as shown in FIGS. 1 and 2, the platform is further provided with a collar 32 which is engageable with and received by the shaft.

Mounted on flotation member 30 are one or more conduits 40. Conduits 40 are radially extending from the approximate center of the platform to the outer terminal edge of the platform and are equidistantly spaced one to another. Each conduit is provided with an inlet port, adjacent the vertical axis of the flotation member, which is submersed in the liquid to be pumped and upon which the flotation member rides. Each conduit 40 is also provided with an outlet or discharge port at its opposing end adjacent the outer terminal edge of platform 33 of flotation member 30.

Drive means 50 of the present invention may be in the form of any conventional drive system. In the preferred embodiment, as shown in FIGS. 1 and 2, drive system 50 includes a power plant 51, in the form of a engine or motor, and a gear system including a pinion 52 driven by power plant 51 and engaging bevel gear 53 which is mounted on platform 33 of flotation member 30. In the embodiment shown in FIG. 3 power plant 51 drives one of the wheels 22 which frictionally engages the outer edge of flotation member 30. Power plant 51 in the embodiment shown in FIGS. 1 and 2 is mounted directly to vertical shaft 21. Where it is known that the level of the water in the reservoir will vary, the power plant may be mounted to shaft 21 as by a slot and spline arrangement so as to be vertically moveable on the shaft. The power plant used in the embodiment shown in FIG. 3 may be mounted on any fixed support structure.

In operation, and assuming use of the invention as shown in FIGS. 1 and 2, activation of power plant 52 causes rotation of pinion 52 in its engagement with beveled gear 53 for rotating flotation member 30 about shaft 21 with collar 32 preventing lateral movement. It will be noted that as flotation member 30 is rotated about the shaft that the flotation member engages the water only with the downwardly depending annular flanges 31 and 35. Air 5 trapped in the flotation tank defined by air tight platform 33 and flanges 31 and 35 serves as a extremely low friction bearing in supporting flotation member 30 over liquid 1. Inlet ports 41, submersed in liquid 1, as for example water, receive the water which is to be discharged through outlet ports 42 to an area on the outside periphery of platform 33 of the flotation member. Inlet ports 41 may face the direction of rotation to be self-priming. Where the inlet ports are vertically faced or faced rearward of the direction of rotation, conduits 40 will require priming. Once primed, the inertia of the water flowing through the conduits maintain the flow. Water discharged from outlet ports 42 of conduits 40 may be used for any desired purpose such as aeration, irrigation, or any other useful purpose. The embodiment shown in FIG. 3 works in like manner with the flotation member being rotated by power plant 51 through wheel 22 in its engagement with the flotation member. A pinion gear arrangement may, of course, be substituted for the frictional engagement of the wheel against the flotation member.

Having thus described in detail a preferred selection of embodiments of the present invention, it is to be appreciated and will be apparent to those skilled in the art that many physical changes could be made in accordance without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A pump comprising:

lateral support means:

a rotatable flotation member vertically moveable in relationship to and laterally supported by said support means, said flotation member including a circular horizontal platform and at least two spaced concentric downwardly depending annular flanges sealingly engaging said platform open-ended flotation air tanks therebetween for rotation of said flotation member on a column of air;

at least one radially extending conduit supported by said flotation member, each of said conduits having an inlet port adjacent the vertical axis of said flotation member and an outlet port on the opposing end thereof; and drive means for rotating said flotation member.

2. The apparatus as described in claim 1 therein said lateral support means comprises a vertically extending shaft and wherein said flotation member includes a collar for receiving said shaft.

3. A pump comprising:

lateral support means including a vertically extending shaft;

a flotation member including a circular platform and at least two downwardly depending concentric spaced annular flanges sealingly engaging said platform to define one or more open-ended flotation air tanks therebetween, for rotation of said flotation member on a column of air, said platform provided with an annular collar adapted to rotatingly receive said shaft;

a plurality of evenly spaced radially extending conduits mounted on said platform, each of said conduits provided with a liquid intake port adjacent the vertical axis of said flotation member and a liquid discharge port adjacent the outer edge of said flotation member; and drive means for rotating said flotation member about said shaft for the displacement of liquid through said conduits.

* * * * *